US010390615B2

(12) United States Patent
Bradley

(10) Patent No.: US 10,390,615 B2
(45) Date of Patent: Aug. 27, 2019

(54) CLOSET APPAREL ORGANIZER

(71) Applicant: Dennis Arthur Bradley, Chicago, IL (US)

(72) Inventor: Dennis Arthur Bradley, Chicago, IL (US)

( * ) Notice: Subject to any disclaimer, the term of this patent is extended or adjusted under 35 U.S.C. 154(b) by 158 days.

(21) Appl. No.: 15/439,514

(22) Filed: Feb. 22, 2017

(65) Prior Publication Data

US 2018/0240375 A1 Aug. 23, 2018

(51) Int. Cl.
*A47B 61/00* (2006.01)

(52) U.S. Cl.
CPC ..... *A47B 61/003* (2013.01)

(58) Field of Classification Search
CPC ... A47B 61/003; A47G 25/1471; G09F 3/205; G09F 3/16
See application file for complete search history.

(56) References Cited

U.S. PATENT DOCUMENTS 1,258,941 A * 3/1918 Pease ..... G09F 3/16 24/546
1,540,320 A * 6/1925 Everett ..... G09F 3/16 40/316
2,020,780 A * 11/1935 Hamilton ..... G09F 3/16 40/310
4,045,899 A 9/1977 Richardson
4,322,902 A 4/1982 Lenthall
4,450,639 A 5/1984 Duester
4,951,596 A * 8/1990 Wallace, Jr. ..... G09F 3/16 116/308
5,238,159 A 8/1993 Zuckerman
D423,799 S 5/2000 Sorensen et al.
D510,815 S 10/2005 Hovsepian
D630,444 S * 1/2011 Navarro ..... D6/315
D636,189 S 4/2011 Dickinson et al.
8,087,190 B1 1/2012 Rivera-Andrianakos
D660,018 S 5/2012 Banda
D660,019 S 5/2012 Banda
D660,020 S 5/2012 Banda
8,863,415 B2 10/2014 Muraco et al.
9,339,135 B2 5/2016 Terkanian
9,595,210 B1 * 3/2017 Rauckman ..... G09F 3/0295
(Continued)

OTHER PUBLICATIONS

Baby Buddy Size-It Closet Organizers in Blue, Bed Bath & Beyond (5 pages) Link: http://www.bedbathandbeyond.com/1/1/5105-baby-buddy-size-it-closet-organizers-blue-set-of-5.html.
(Continued)

*Primary Examiner* — Gary C Hoge
(74) *Attorney, Agent, or Firm* — K&L Gates LLP

(57) ABSTRACT

A closet apparel organizer includes a label plate having a first surface and a second surface, a first body member connected to a first location of the label plate, a second body member connected to a second location of the label plate, and a reception member connected to the first body member and the second body member. The reception member is configured to engage with a closet rod and includes an entrance opening. The first surface is facing in an outward direction away from the first and second body members and the second surface is facing in an inward direction towards the first and second body members.

16 Claims, 5 Drawing Sheets

(56) References Cited

U.S. PATENT DOCUMENTS

| | | | | |
|---|---|---|---|---|
| 2002/0032102 | A1* | 3/2002 | Boire | G09F 3/00 482/11 |
| 2003/0033744 | A1 | 2/2003 | Alexander | |
| 2005/0161415 | A1* | 7/2005 | Iversen | A47F 7/24 211/85.3 |
| 2009/0126245 | A1* | 5/2009 | Currin | G09F 3/06 40/673 |
| 2017/0238746 | A1* | 8/2017 | Fikri | A47G 25/1471 |

OTHER PUBLICATIONS

A Shopping Queen's Blog (9 pages) Link: http://chumsyashley.com/?p=2288.

Custom Closet Size Dividers Clothes Organizer Baby Toddler Boy Girl Grey Chevron, ebay, web page accessed Nov. 21, 2015 (4 pages).

Blank Plastic Rectangular Rack Size Dividers for Retail Clothing Racks, ebay, Feb. 13, 2017 (3 pages) Link: http://www.ebay.com/itm/QTY-40-BLANK-PLASTIC-RECTANGULAR-RACK-SIZE-DIVIDERS-FOR-RETAIL-CLOTHING-RACKS-/251716358700?hash=item3a9b76d22c:m:mvmfxMYCG_ZN7nGSOzK1QZg.

Baby Closet Dividers Baby Shower Gift Closet Organizers Yellow Nursery Gray Nursery Chevron Stripes Dots Finished Product Cd228A, etsy, Nov. 15, 2016 (3 pages) Link: https://www.etsy.com/listing/231719800/sale-baby-closet-dividers-baby-shower.

Google Search—closet rod organizer tag, web page accessed Nov. 21, 2015 (1 page).

Clothing Dividers (for round pole), Little Interiors—Interior Design Blog, 2017 (4 pages) Link:http://www.littleinteriors.co.za/product/littleme-cupboard-organizer/.

White Round Blank Size Dividers, Copyright 2005-2017, Only Hangers (3 pages) Link: http://www.onlyhangers.com/hanger-accessories/521-white-round-blank-size-dividers.html?gclid=CjwKEAjwz4u9BRCbioK3stnBznESJADA75xbH3P6w1Elgl8eDgDXHDAle0ul57FcNOopobVv1wY_PBoCbA3w_wcB.

Explore Outfits Daily, Weekly Outfits, and more!, Pinterest (6 pages)Link: https://www.pinterest.com/pin/322007442080236933/.

Ideas, Pinterest (8 pages) Link: https://www.pinterest.com/kguehrer/ideas/.

Closet Organizer 5ct—Color: Sage, Rakuten.com, web page accessed Nov. 21, 2015 (1 page).

Aluminum Braille Clothing Labels, copyright 1998-2017 RehabMart.com, LLC (20 pages)Link: http://www.rehabmart.com/product/aluminum-braille-clothing-labels-30539.html.

Unisex Size Dividers for Clothing Racks, Amazon (5 pages) Link: https://www.amazon.com/Unisex-Size-Dividers-Clothing-Racks/dp/B00O55YL5Q.

Simple Division Garment Organizers, 12 white Garment Organizers plus 60 Sorting Labels, Amazon (6 pages) Link: https://www.amazon.com/Simple-Division®-Garment-Organizers-Sorting/dp/B000RPMW04.

Simple Division Closet Rod Organizers, The Container Store, web page accessed Nov. 21, 2015 (1 page).

The Happy Closet Baby Closet Dividers, Blue and Chocolate, The Happy Closet, Inc., www.fishpond.com, web page accessed Nov. 21, 2015 (1 page).

Round Size Dividers—Blank, Uline, web page accessed Nov. 21, 2015 (1 page).

* cited by examiner

CLOSET APPAREL ORGANIZER

BACKGROUND

The present disclosure generally relates to a closet apparel organizer. Closet apparel organizers help users organize closets and classify apparel by the apparel type. Using closet apparel organizers, users can utilize limited closet space more efficiently. Closet apparel organizer may enable users to find a particular type of apparel quickly and easily.

SUMMARY

The present disclosure provides a new and innovative closet apparel organizer. In an example, a closet apparel organizer includes a label plate having a first surface and a second surface, a first body member connected to a first location of the label plate, a second body member connected to a second location of the label plate, and a reception member connected to the first body member and the second body member. The reception member is configured to engage with a closet rod and includes an entrance opening. The first surface faces an outward direction away from the first and second body members and the second surface faces an inward direction towards the first and second body members.

In another example, a closet apparel organizer with an adjuster includes a body having a label plate, a first body, a second body, and a reception member. The label plate includes a first surface and a second surface. The first body member is connected to a first location of the label plate and the second body member is connected to a second location of the label plate. The reception member is connected to the first body member and the second body member, and the reception member is configured to engage with a closet rod and includes an entrance opening. The first surface faces an outward direction away from the first and second body members and the second surface faces an inward direction towards the first and second body members.

The adjuster includes a second reception member, a third guide member, a fourth guide member, and a locking mechanism. The second reception member includes a first end and a second end opposite the first end. The second reception member also includes a third entrance opening. The third guide member is connected to the first end of the second reception member and the fourth guide member is connected to the second end of the second reception member. The third guide member and the fourth guide member are configured to guide the closet rod to the second reception member. The locking mechanism is mounted to at least one of the second reception member, the third guide member, and the fourth guide member. The locking mechanism is configured to releasably lock the body and the adjuster together. The second reception member is placed inside the reception member.

In another example, a closet apparel organizer includes a label plate, a reception member, a first guide member, and a second guide member. The label plate includes a first surface and a second surface. The reception member is connected to the second surface of the label plate. The reception member is configured to engage with a closet rod and includes an entrance opening. The first guide member is connected to the reception member near a first end of the reception member and the second guide member is connected to the reception member near a second end of the reception member. The second end of the reception member is opposite the first end of the reception member. The first guide member and the second guide member are configured to guide the closet rod to the reception member. The first surface faces an outward direction away from the first and second body members and the second surface faces an inward direction towards the first and second body members.

Additional features and advantages of the disclosed methods are described in, and will be apparent from, the following Detailed Description and the Figures.

DETAILED DESCRIPTION OF EXAMPLE EMBODIMENTS

Figure 1:
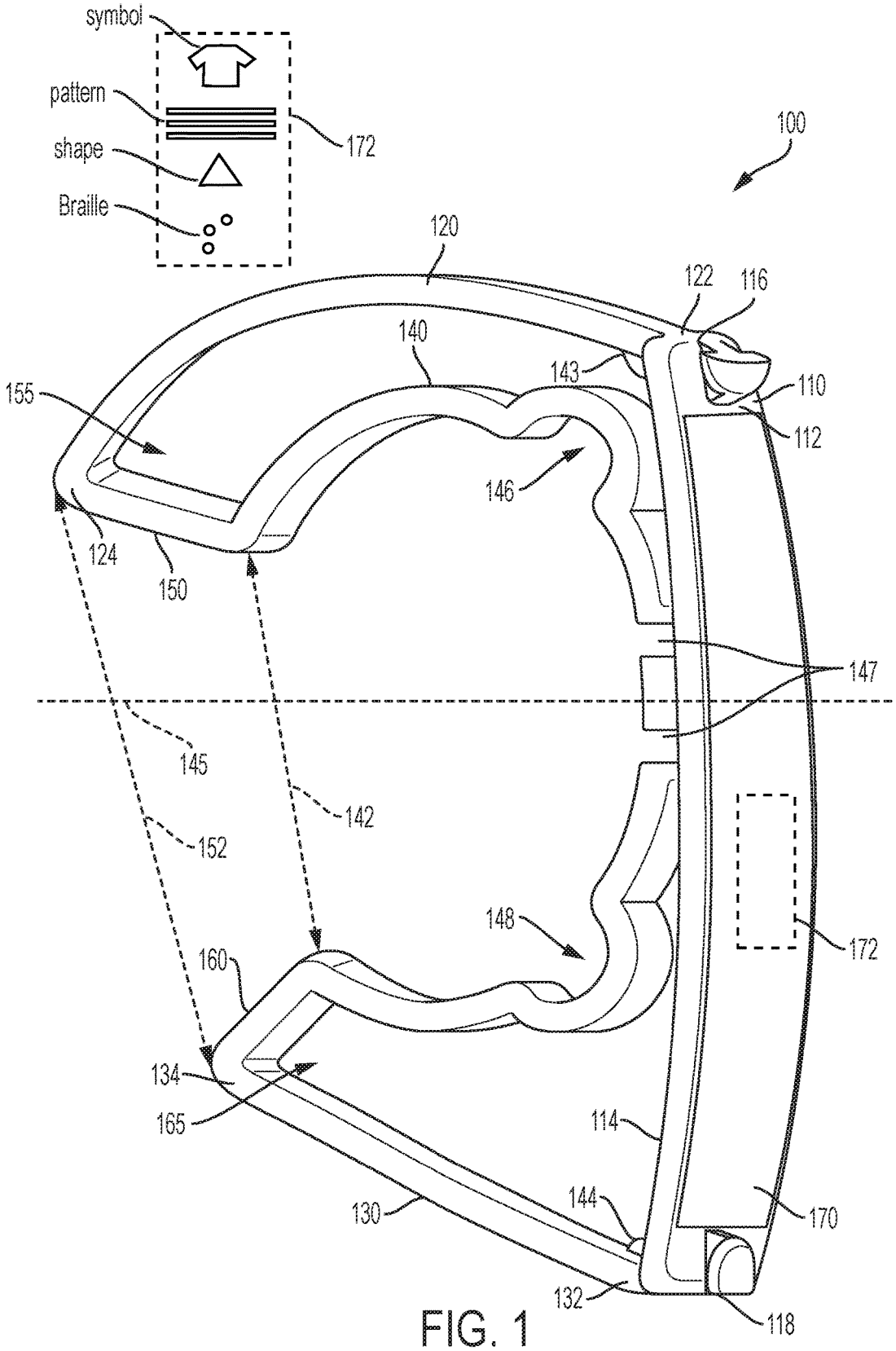
FIG. 1 is a perspective view of a closet apparel organizer according to an example embodiment of the present disclosure.

Described herein is a new and innovative closet apparel organizer. In an example, a closet apparel organizer may include a label plate, a first body member, a second body member, and a reception member. The label plate may include a first surface and a second surface. The first surface may be facing in an outward direction away from the first and second body members and the second surface may be facing in an inward direction towards the first and second body members. The first body member may be connected to a first location of the label plate and the second body member may be connected to a second location of the label plate. The reception member may be connected to the first body member and the second body member. The reception member may be configured to engage with a closet rod and include an entrance opening. The reception member may clip to the closet rod.

In an example, at least one of the body members may be disposed at an obtuse angle with respect to the label plate and may be bent down toward the entrance opening, which may allow the at least one of the body members to move more freely when the closet rod is passing through the entrance opening. In this way, the body member may absorb the stress generated when a closet rod is passing through the entrance opening, which may advantageously prevent the closet apparel organizer from failing (e.g., cracking or fracturing due to repeated stresses applied when inserting or removing the closet rod) and may advantageously improve the durability of the closet apparel organizer.

The layout and structure of many wardrobe rooms and closets requires users to view the closet rod at an angle or from the side of the closet rod. However, conventional closet apparel organizers are generally configured to be viewed from the front side of the closet rod. Therefore, it would be difficult for a user who is standing on the side of the closet rod to check the conventional closet apparel organizers. In an example of the present disclosure, the reception member may define a longitudinal axis substantially perpendicular to the second surface of the label plate. The reception member may be configured to engage with the closet rod along the longitudinal axis so that the label plate can be seen from various viewing angles (e.g., viewing from a side of the closet rod). Unlike the conventional closet apparel organizers, the present disclosure enables the label plate to be viewed well from a side of the closet rod by having the label plate face the user standing on the side of the closet rod when the closet apparel organizer is engaged with the closet rod.

In an example, the reception member may also include wire rack receivers configured to engage with a wire rack (e.g., vertical or horizontal sections of the wire rack). Therefore, an example closet apparel organizer constructed according to aspects of the present disclosure may be capable of engaging not only with a closet rod, but also with a wire rack.

In an example, the closet apparel organizer may include an adjuster that enables the closet apparel organizer to be used with different closet rod or rack sizes. The adjuster may include a second reception member configured to be placed inside the reception member of the closet apparel organizer. The second reception member may be engaged with a closet rod having a smaller size than the closet rod with which the reception member of the closet apparel organizer is configured to be engaged. The adjuster may include a locking mechanism that releasably locks the adjuster with the closet apparel organizer. For example, the adjuster may include a locking tab, which may be releasably locked with a locking channel formed between the body member and the reception member of the closet apparel organizer.

In addition to the locking tab, the adjuster may also include one or more bars, which may be inserted into one or more holes formed in the reception member of the closet apparel organizer. In an example, the reception member of the closet apparel organizer may be connected to the label plate and the one or more holes may be formed in a location where the reception member is connected with the label plate. This may enable the adjuster to be stably fixed to the label plate and, ultimately, to the closet apparel organizer.

FIG. 1 illustrates a closet apparel organizer 100 according to an example embodiment of the present disclosure. The closet apparel organizer 100 may include a label plate 110, a first body member 120, a second body member 130, and a reception member 140. The label plate 110 may include a first surface 112 and a second surface 114. The first surface 112 may be facing in an outward direction away from the first and second body members 120, 130 and the second surface 114 may be facing in an inward direction towards the first and second body members 120, 130. The first body member 120 may be connected to a first location of the label plate 110 and the second body member 130 may be connected to a second location of the label plate 110. In an example, the label plate 110 may include a first end 116 and a second end 118 opposite the first end 116. In an example, the first location may be near the first end 116 of the label plate 110. The second location may be near the second end 118 of the label plate 110.

The reception member 140 may be connected to the first body member 120 and the second body member 130. The reception member 140 may be configured to engage with a closet rod (now shown) and include an entrance opening 142. For example, the reception member 140 may be adapted to clip to the closet rod. For example, a closet rod may be press-fit into the reception member 140. In an example, once the reception member 140 is engaged with the closet rod, the reception member 140 may be releasably fixed to the closet rod so that the label plate 110 does not face down due to gravity and can be viewed by a user. For example, the reception member 140 may be sized such that it creates a compression fit with the closet rod with enough friction to retain a specific orientation of the closet apparel organizer 100 on the closet rod. In an example, the reception member 140 may have a circular shape to accept the closet rod. Additionally, the reception member 140 may have any shape suitable for engaging a closet rod. In an example, the diameter of the reception member 140 may be greater than the length of the entrance opening 142. In an example, the inner surface of the reception member 140 may include a textured surface or an anti-slip coating to further enhance the compression/friction fit with the closet rod.

As illustrated in FIG. 1, in an example, the first body member 120 may be disposed at an obtuse angle with respect to the second surface 114 of the label plate 110. That is, an angle 143 formed between the first body member 120 and the second surface 114 of the label plate 110 may be more than 90 degrees. At least a portion of the first body member 120 may be bent down toward the entrance opening 142. The second body member 130 may be disposed at an acute angle with respect to the second surface 114 of the label plate 110. That is, an angle 144 formed between the second body member 130 and the second surface 114 of the label plate 110 may be less than 90 degrees. In another example, both the first and second body members 120, 130 may be disposed at an obtuse angle with respect to the second surface 114 of the label plate 110 and at least a portion of the first and second body members 120, 130 may be bent down toward the entrance opening 142. In another example, both the first and second body members 120, 130 may be disposed at an acute angle with respect to the second surface 114 of the label plate 110.

In general, a closet rod may have a diameter that is bigger than the entrance opening 142. Therefore, there may be some stresses applied to the overall closet apparel organizer 100 when the closet rod is passing through the entrance opening 142 (e.g., when inserting or removing the closet rod). This may cause some cracks or fracture of the closet apparel organizer 100. In an example, the first body member 120 and/or second body member 130 may be made of a material that has sufficient flexibility and durability. Additionally, the body member (e.g., first body member 120 and/or second body member 130) may be disposed at an obtuse angle with respect to the label plate 110 and at least a portion of the body member is bent down toward the entrance opening 142, as illustrated in FIG. 1, which may allow the body member to gradually spread apart when the closet rod is passing through the entrance opening 142. In this way, the body member may gradually absorb the stress generated when a closet rod is passing through the entrance opening 142 and this may prevent the closet apparel organizer 100 from breaking (e.g., cracking or fracturing) due to repeated stresses applied when inserting or removing the closet rod.

In an example, the closet apparel organizer 100 may include a first guide member 150 and a second guide member 160. The first guide member 150 may be connected between the first body member 120 and the reception member 140. The second guide member 160 may be connected between the second body member 130 and the reception member 140. The first guide member 150 and the second guide member 160 may be configured to guide the closet rod to the reception member 140. For example, the guide members may be configured to align the closet rod with the entrance opening 142.

In an example, a first end 122 of the first body member 120 may be connected to the label plate 110. Additionally, a first end 132 of the second body member 130 may be connected to the label plate 110. A second end 124 of the first body member 120 may be opposite the first end 122 of the first body member 120. A second end 134 of the second body member 130 may be opposite the first end 132 of the second body member 130. In an example, the second end 124 of the first body member 120 and the second end 134 of the second body member 130 may define a second entrance opening 152. In an example, the second entrance opening 152 may be larger than the entrance opening 142. In another example, the second entrance opening 152 may be the entrance opening 142. In this case, the second end 124 of the first body member 120 and the second end 134 of the second body member 130 may define the entrance opening 142.

In an example, the reception member 140 may define a longitudinal axis 145 substantially perpendicular to the second surface 114 of the label plate 110. The reception member 140 may be configured to engage with the closet rod along the longitudinal axis 145 so that the label plate 110 can be seen from a side of the closet rod. Additionally, the label plate 110 may be oriented at an angle such that the label 170 may be viewed at a specific viewing angle. In another example, the label plate 110 may be adjustable, such as placed on a swivel, such that it can be adjusted for various viewing angles. In an example, the reception member 140 may include a first wire rack receiver 146 and a second wire rack receiver 148. The first wire rack receiver 146 and the second wire rack receiver 148 may be configured to engage with a wire rack (not shown). For example, the first and second wire rack receivers 146, 148 may be engaged with a vertical or horizontal section of a wire rack. In an example, the first guide member 150 and the second guide member 160 may guide and align the closet apparel organizer 100 such that the wire rack receivers 146, 148 align with and engage the wire rack.

In an example, the closet apparel organizer 100 may include a label 170 configured to be attached to the first surface 112 of the label plate 110. In an example, an adhesive layer may be used to attach the label 170 to the first surface 112. In an example, the adhesive layer may be pre-applied to the label 170. The label 170 may include an apparel identification such as "Shirts," "Pants," "Coats," "Dresses," "Blouses," "Suits," "Sports Coats," "Work Pants," "Gowns," "Tuxedo," etc. In an example, the apparel identification may be formed directly on the first surface 112 of the label plate 110. In an example, the label 170 may include surface features 172, such as Braille characters for sight challenged users. For example, the label plate 110 may include Braille characters that describe an item, such as an apparel item on the closet apparel organizer 100. In another example embodiment, the label 170 may include surface features 172, such as a shape(s), a pattern (a), and/or a symbol(s), to specify the type of clothing. For example, a circle surface feature may specify "shirts" and a square surface feature may specify "pants". A horizontal stripe pattern may specify "coats" and a checker pattern may specify "dresses." Additionally, a label plate 110 may be shaped like a triangle or may include a triangle protrusion to signify that the closet apparel organizer is for a sports coat. Other shapes and combinations of surface features 172 may be used to designate closet apparel organizers for a wide variety of clothing. In an example, the label plate 110 may be interchangeable. For example, the closet apparel organizer 100 may include a removable label plate 110, which can be replaced with the appropriate label 170 to designate the desired clothing type.

In an example, the closet apparel organizer 100 may include an audio device (not shown). The audio device may include a memory and a speaker. The memory may include one or more pre-recorded recordings, which may identify the apparel types, including "Shirts," "Pants," "Coats," "Dresses," "Blouses," "Suits," "Sports Coats," "Work Pants," "Gowns," "Tuxedo," etc. The audio device may play the recordings pre-recorded in the memory through the speaker when the play button is touched by a user. For example, the audio device may play a recording as a user passes in front of the closet apparel organizer 100. In an example, the audio device may include a sensor to sense when a user is viewing or touching the closet apparel organizer 100. In another example, the audio device may include a play button. The audio device may further include a record button such that a user may be able to record the apparel type in person. In an example, the audio device may include a remove button configured to remove the recording in the memory so that the user can make a new recording. In another example, the audio device may be configured to automatically overwrite an existing recording. In an example, the closet apparel organizer 100 may be made of plastic or similar light weight material. The closet apparel organizer 100 may be translucent, transparent, opaque, or any combination thereof. In another example, the closet apparel organizer 100 may be made of metal or similar strong material providing for enhanced strength and rigidity. In another example, any suitable material known in the art with similar characteristics can be used to produce the closet apparel organizer 100, for example, such as rubber, wood, silicon, etc. In further embodiments, the closet apparel organizer 100 may be made of a combination of different materials (e.g., plastic or similar lightweight material and metal or similar strong material). Additionally, the closet apparel organizer 100 may be made from a single mold or multiple molds.

In an example, a thickness of the first body member 120, the second body member 130, and/or the reception member 140 may be greater than a thickness of the label plate 110. In another example, the thickness of the first body member 120, the second body member 130, and/or the reception member 140 may be equal or smaller than the thickness of the label plate 110. In an example, the first body member 120, the second body member 130, the reception member 140, the first guide member 150, and the second guide member 160 may have a thickness in a range of about 0.5 mm to about 3 mm, and the label plate 110 may have a thickness in a range of about 0.1 mm to about 2 mm. In an example, the label plate 110, the first body member 120, the second body member 130, the reception member 140, the first guide member 150, and the second guide member 160 may have any suitable thickness.

In an example, a width of the first body member 120, the second body member 130, and the reception member 140 may be smaller than a width of the label plate 110. In another example, the width of the first body member 120, the second body member 130, and the reception member 140 may be equal or greater than the width of the label plate 110. In an example, the first body member 120, the second body member 130, the reception member 140, the first guide member 150, and the second guide member 160 may have a width in a range of about 1 mm to about 10 mm, and the label plate 110 may have a width in a range of about 8 mm to about 50 mm. In an example, the label plate 110, the first body member 120, the second body member 130, the reception member 140, the first guide member 150, and the second guide member 160 may have any suitable width. In an example, the label plate 110 may have a length in a range of about 20 mm to about 70 mm. In another example, the label plate 110 may have any suitable length.

Figure 2A:
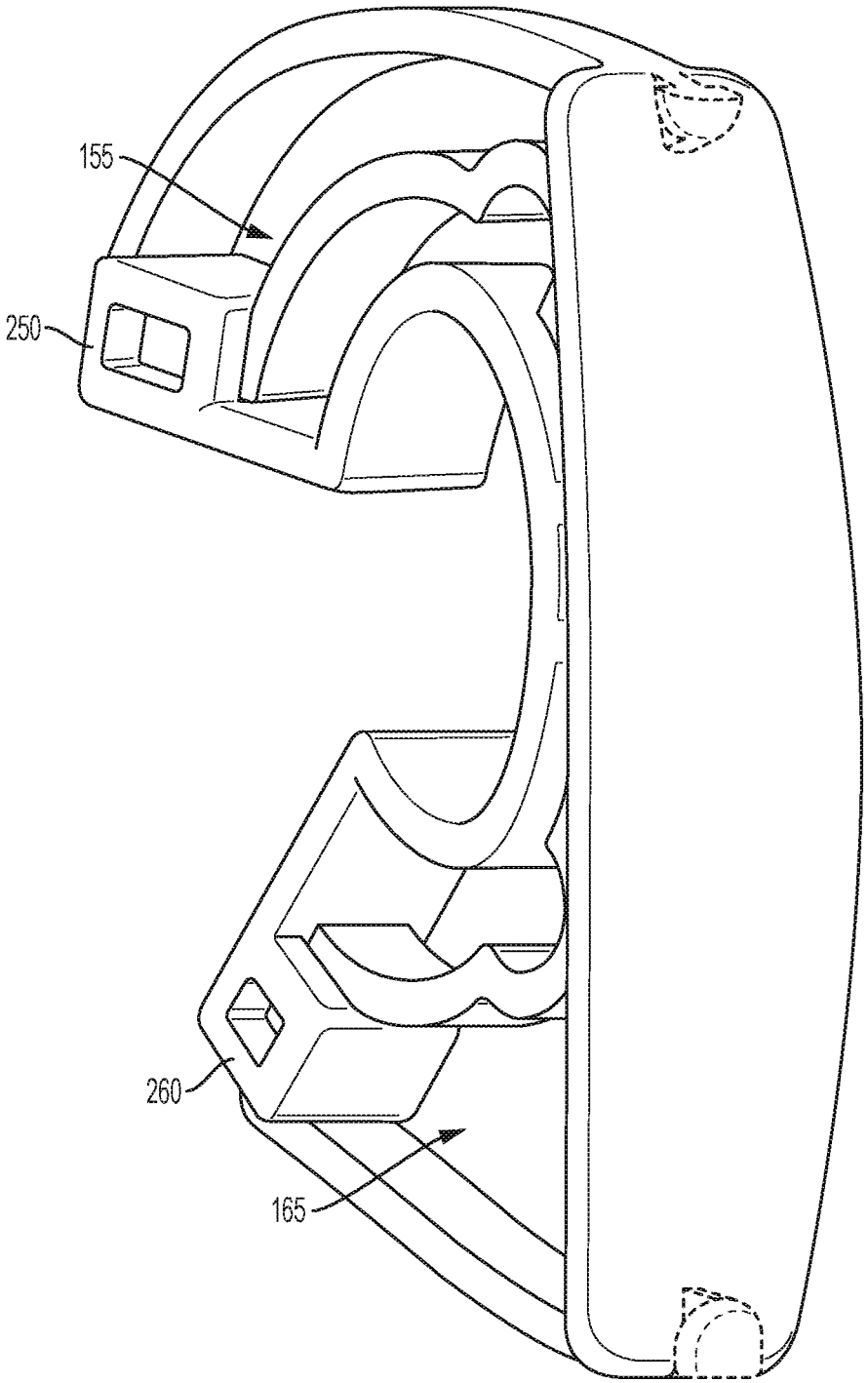
FIGS. 2A and 2B are perspective and left side views of the closet apparel organizer of FIG. 1 with an adjuster according to an example embodiment of the present disclosure.
Figure 2B:
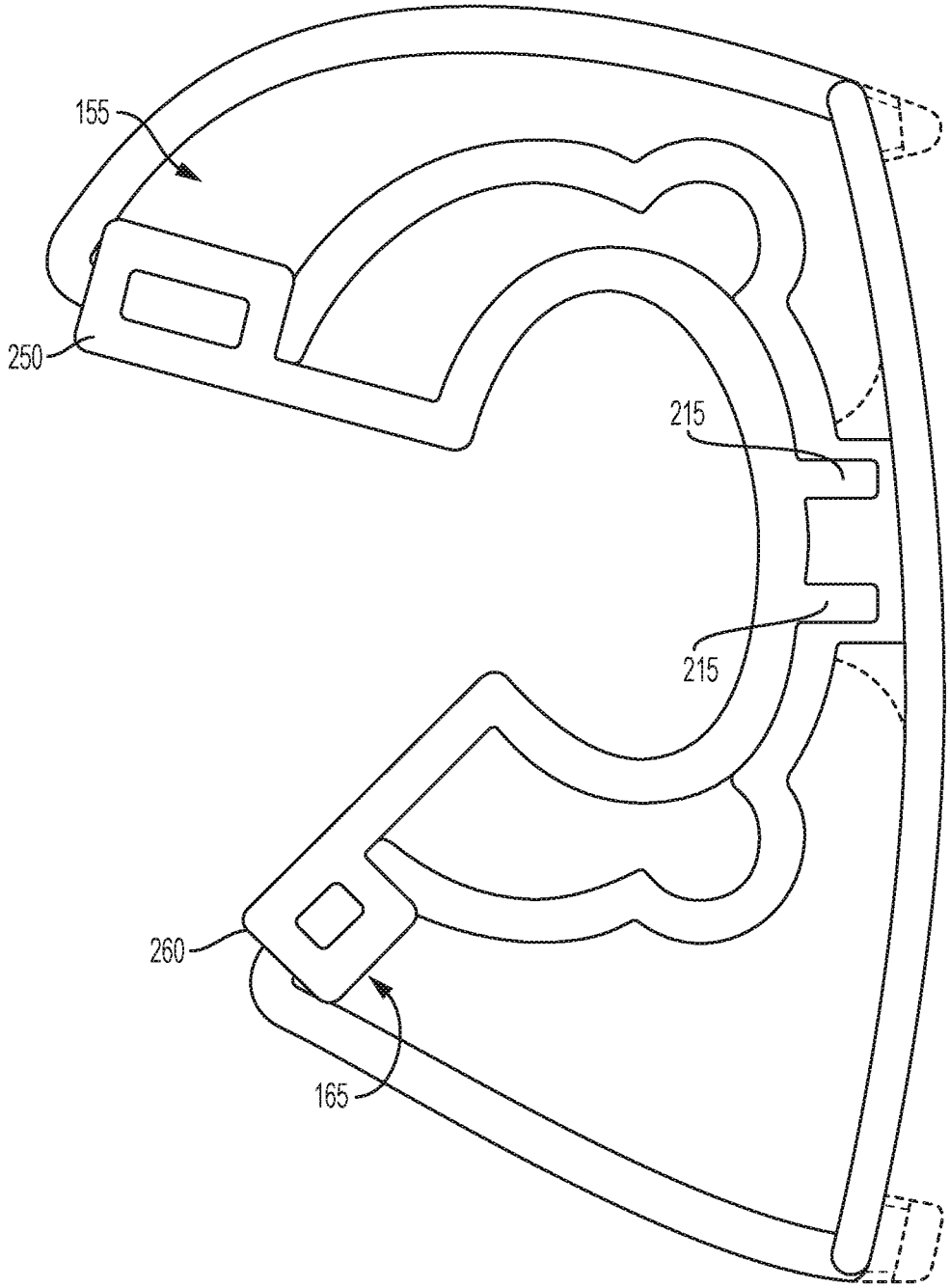
Figure 3:
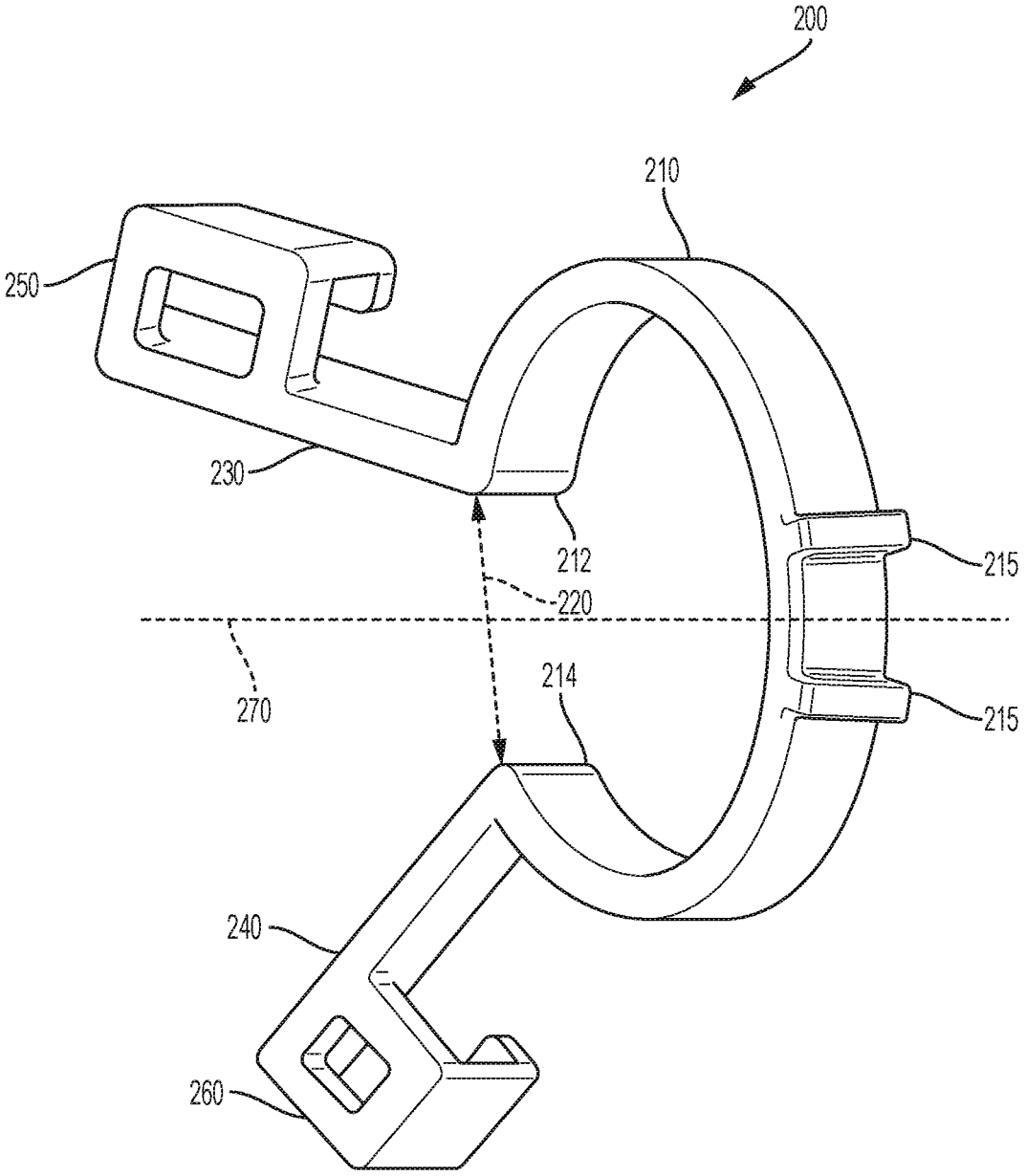
FIG. 3 is a perspective view of the adjuster of FIGS. 2A and 2B according to the example embodiment of the present disclosure.

FIGS. 2A and 2B illustrate the closet apparel organizer 100 with an adjuster 200 according to an example embodiment of the present disclosure. FIG. 3 illustrates the adjuster 200 according to the example embodiment of the present disclosure.

The adjuster 200 may include a second reception member 210. The second reception member 210 may include a first end 212 and a second end 214 opposite the first end 212. The second reception member 210 may also include a third entrance opening 220. The adjuster 200 may include a third guide member 230 and a fourth guide member 240. The third guide member 230 may be connected to the first end 212 of the second reception member 210. The fourth guide member 240 may be connected to the second end 214 of the second reception member 210. The third guide member 230 and the fourth guide member 240 may be configured to guide the closet rod to the second reception member 210.

The adjuster 200 may also include a locking mechanism. In an example, the locking mechanism may be mounted to at least one of the second reception member 210, the third guide member 230, and the fourth guide member 240. The locking mechanism may be configured to releasably lock the closet apparel organizer 100 and the adjuster 200 together. In an example, the locking mechanism may include a snap, an interlocking tab, a hook-and-loop fastener, or any other mechanism known by one of ordinary skill in the art to releasably lock the closet apparel organizer and the adjuster 200 together.

In an example, the second reception member 210 may be placed inside the reception member 140. The adjuster 200 placed in the reception member may enable the closet apparel organizer 100 to be used with different closet rod or rack sizes. The second reception member 210 may clip to a closet rod. In an example, once the second reception member 210 is engaged with the closet rod, the second reception member 210 may be releasably fixed to the closet rod so that the label plate 110 does not face down due to gravity and can be viewed by a user. For example, the reception member 210 may be sized such that it creates a compression fit with the closet rod with enough friction to retain a specific orientation of the closet apparel organizer 100 on the closet rod. In an example, the second reception member 210 may have a circular shape to accept the closet rod. In another example, the second reception member 210 may have any shapes suitable for engaging a closet rod. In an example, the diameter of the second reception member 210 may be greater than the length of the third entrance opening 220. In an example, the inner surface of the reception member 210 may include a textured surface or an anti-slip coating to further enhance the compression/friction fit with the closet rod.

In an example, the closet apparel organizer 100 may further include a first locking channel 155 formed between the first body member 120 and the reception member 140. In an example, the closet apparel organizer 100 may also include a second locking channel 165 formed between the second body member 130 and the reception member 140. In an example, the first body member 120, the first guide member 150, and the reception member 140 may define the first locking channel 155. In an example, the second body member 130, the second guide member 160, and the reception member 140 may define the second locking channel 165.

In an example, the adjuster 200 may include a first locking tab 250 connected to the third guide member 230 and a second locking tab 260 connected to the fourth guide member 240. In an example, the locking mechanism may include the first locking tab 250 mounted to the third guide member 230 and/or the second locking tab 260 mounted to the fourth guide member 240. In an example, the first locking channel 155 and the first locking tab 250 may be releasably locked. In an example, the second locking channel 165 and the second locking tab 260 may be releasably locked. In an example, the first locking tab 250 may be interlocked with the first body member 120, the first guide member 150, or the reception member 140 through the first locking channel 155. Similarly, the second locking tab 260 may be interlocked with the second body member 130, the second guide member 160, or the reception member 140 through the second locking channel 165. In an example, the first locking tab 250 may include a hook portion. The hook portion may be configured to engage with the first body member 120, the first guide member 150, or the reception member 140. The second locking tab 260 may also include a hook portion, which may be configured to engage with the second body member 130, the second guide member 160, or the reception member 140.

In an example, the reception member 140 may include one or more holes, cavities, or apertures 147. In an example, the reception member 140 may be connected to the label plate 110. In an example, the locking mechanism may be mounted to the second reception member 210. In this case, the locking mechanism may include one or more bars 215 formed on the second reception member 210. The one or more bars 215 may be configured to be inserted into the one or more holes 147 in the reception member 140. In an example, the one or more holes 147 may be formed in the location where the reception member 140 is connected with the label plate 110. This may enable the adjuster 200 to be stably fixed to the label plate 110 and, ultimately, to the closet apparel organizer 100. In an example embodiment, the holes 147 and the bars 215 may include velcro or other attachment means to further strengthen the connection.

In an example, the second reception member 210 may define a second longitudinal axis 270 substantially perpendicular to the second surface 114 of the label plate 110. The second reception member 210 may be configured to engage with a closet rod along the second longitudinal axis 270 so that the label plate 110 can be seen from a side of the closet rod. In an example, the second reception member 210 may include a third wire rack receiver and a fourth wire rack receiver (not shown), which are similar to the first and second wire rack receivers 146, 148. The third wire rack receiver and the fourth wire rack receiver may be configured to engage with a wire rack.

In an example, the adjuster 200 may be made of plastic or similar light weight material. The adjuster 200 may be translucent, transparent, opaque, or any combination thereof. In another example, the adjuster 200 may be made of metal or similar strong material providing for enhanced strength and rigidity. In another example, any suitable material known in the art with similar characteristics can be used to produce the adjuster 200, for example, such as rubber, wood, silicon etc. In further embodiments, the adjuster 200 may be made of a combination of different materials (e.g., plastic or similar lightweight material and metal or similar strong material). Additionally, the adjuster 200 may be made from a single mold or multiple molds.

In an example, a thickness of the second reception member 210, the third guide member 230, and/or the fourth guide member 240 may be greater than the thickness of the label plate 110. In another example, the thickness of the second reception member 210, the third guide member 230, and/or the fourth guide member 240 may be equal or smaller than the thickness of the label plate 110. In an example, the second reception member 210, the third guide member 230, and the fourth guide member 240 may have a thickness in a range of about 0.5 mm to about 3 mm. In an example, each part of the adjuster 200 (e.g., the second reception member 210, one or more bars 215, the third guide member 230, the fourth guide member 240, the first locking tab 250, and the second locking tab 260) may have any suitable thickness.

In an example, a width of the second reception member 210, the third guide member 230, and/or the fourth guide member 240 may be smaller than the width of the label plate 110. In another example, the width of the second reception member 210, the third guide member 230, and/or the fourth guide member 240 may be equal or greater than the width of the label plate 110. In an example, the second reception member 210, the third guide member 230, and the fourth guide member 240 may have a width in a range of about 1 mm to about 10 mm. In an example, each part of the adjuster 200 (e.g., the second reception member 210, one or more bars 215, the third guide member 230, the fourth guide member 240, the first locking tab 250, and the second locking tab 260) may have any suitable width.

In an example, the width of the second reception member 210, the third guide member 230, the fourth guide member 240, the first locking tab 250, and/or the second locking tab 260 may be greater than the width of the first body member 120, the second body member 130, the reception member 140, the first guide member 150, and/or the second guide member 160. In another example, the width of the second reception member 210, the third guide member 230, and the fourth guide member 240 may be equal or smaller than the width of the first body member 120, the second body member 130, the reception member 140, the first guide member 150, and/or the second guide member 160.

Figure 4:
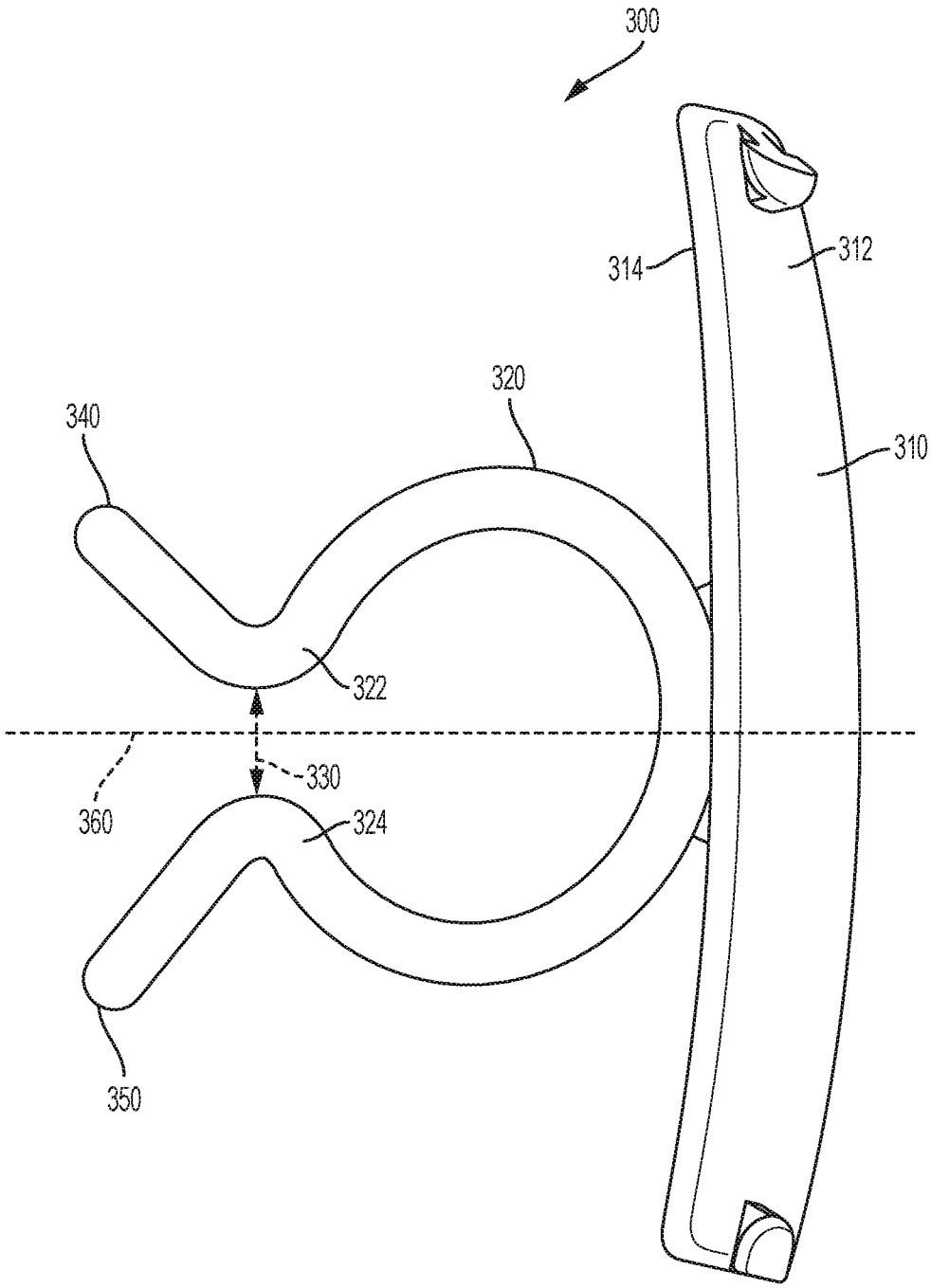
FIG. 4 is a perspective view of a closet apparel organizer according to another example embodiment of the present disclosure.

FIG. 4 illustrates a closet apparel organizer 300 according to another example embodiment of the present disclosure. The closet apparel organizer 300 may include a label plate 310 and a reception member 320. The label plate 310 may include a first surface 312 and a second surface 314. The reception member 320 may be connected to the second surface 314 of the label plate 310. In an example, the reception member 320 may be connected to the center of the second surface 314. In another example, the reception member may be connected to any other suitable location of the second surface 314.

The reception member 320 may be configured to engage with a closet rod. The reception member 320 may clip to a closet rod. In an example, once the reception member 320 is engaged with the closet rod, the reception member 320 may be releasably fixed to the closet rod so that the label plate 310 does not face down due to gravity and can be viewed by a user. For example, the reception member 320 may be sized such that it creates a compression fit with the closet rod with enough friction to retain a specific orientation on the closet rod. In an example, the reception member 320 may have a circular shape to accept the closet rod. In another example, the reception member 320 may have any shapes suitable for engaging a closet rod. The reception member 320 may also include a first end 322 and a second end 324 opposite the first end 322. The reception member 320 may include an entrance opening 330. In an example, the first end 322 and second end 324 of the reception member 320 may define the entrance opening 330. In an example, the diameter of the reception member 320 may be greater than the length of the third entrance opening 330. In an example, the inner surface of the reception member 320 may include a textured surface or an anti-slip coating to further enhance the compression/friction fit with the closet rod.

In an example, the closet apparel organizer 300 may include a first guide member 340 and a second guide member 350. The first guide member 340 may be connected to the reception member 320 near the first end 322 of the reception member 320. The second guide member 350 may be connected to the reception member 320 near the second end 324 of the reception member 320. The first guide member 340 and the second guide member 350 may be configured to guide the closet rod to the reception member 320. For example, the guide members may be configured to align the closet rod with the entrance opening 330. The first surface 312 of the label plate 310 may be facing in an outward direction away from the first and second guide members 340, 350 and the second surface 314 of the label plate 310 may be facing in an inward direction towards the first and second guide members 340, 350.

In an example, the reception member 320 may define a longitudinal axis 360 substantially perpendicular to the second surface 314 of the label plate 310. The reception member 320 may be configured to engage with the closet rod along the longitudinal axis 360 so that the label plate 310 can be seen from a side of the closet rod. Additionally, the label plate 310 may be oriented at an angle such that a label may be viewed at a specific viewing angle. In another example, the label plate 310 may be adjustable, such as placed on a swivel, such that it can be adjusted for various viewing angles.

In an example, the reception member 320 may include a first wire rack receiver and a second wire rack receiver (not shown) that are similar to the wire rack receivers 146, 148. The first wire rack receiver and the second wire rack receiver may be configured to engage with a wire rack (not shown). For example, the first and second wire rack receivers may be engaged with a vertical or horizontal section of a wire rack. In an example, the first guide member 340 and the second guide member 350 may guide and align the closet apparel organizer 300 such that the wire rack receivers align with and engage the wire rack.

In an example, the closet apparel organizer 300 may include a label configured to be attached to the first surface 312 of the label plate 310. In an example, an adhesive layer may be used to attach the label to the first surface 312. In an example, the adhesive layer may be pre-applied to the label. The label may include an apparel identification such as "Shirts," "Pants," "Coats," "Dresses," "Blouses," "Suits," "Sports Coats," "Work Pants," "Gowns," "Tuxedo," etc. In an example, the apparel identification may be formed directly on the first surface 312 of the label plate 310. In an example, the label may include surface features, such as Braille characters for sight challenged users. In an example, the label plate 110 may include Braille characters. In another example embodiment, the label may include surface features, such as a shape, to specify the type of clothing. Additionally, a label plate 310 may be shaped like a triangle or may include a triangle protrusion to signify that the closet apparel organizer is for a sports coat. Other shapes and combinations of surface features may be used to designate closet apparel organizers for a wide variety of clothing. In an example, the label plate 310 may be interchangeable. For example, the closet apparel organizer 300 may include a removable label plate 310, which can be replaced with the appropriate label to designate the desired clothing type.

In an example, the closet apparel organizer 300 may be made of plastic or similar light weight material. The closet apparel organizer 300 may be translucent, transparent, opaque, or any combination thereof. In another example, the closet apparel organizer 300 may be made of metal or similar strong material providing for enhanced strength and rigidity. In another example, any suitable material known in the art with similar characteristics can be used to produce the closet apparel organizer 300, for example, such as rubber, wood, silicon, etc. In further embodiments, the closet apparel organizer 300 may be made of a combination of different materials (e.g., plastic or similar lightweight material and metal or similar strong material). Additionally, the closet apparel organizer 100 may be made from a single mold or multiple molds.

In an example, a thickness of the first guide member 340, the second guide member 350, and/or the reception member 320 may be greater than a thickness of the label plate 310. In another example, the thickness of the first guide member 340, the second guide member 350, and/or the reception member 320 may be equal or smaller than the thickness of the label plate 310. In an example, the first guide member 340, the second guide member 350, and/or the reception member 320 may have a thickness in a range of about 0.5 mm to about 3 mm, and the label plate 310 may have a thickness in a range of about 0.1 mm to about 2 mm. In an example, the label plate 310, the first guide member 340, the second guide member 350, and the reception member 320 may have any suitable thickness.

In an example, a width of the first guide member 340, the second guide member 350, and/or the reception member 320 may be smaller than a width of the label plate 310. In another example, the width of the first guide member 340, the second guide member 350, and/or the reception member 320 may be equal or greater than the width of the label plate 310. In an example, the first guide member 340, the second guide member 350, and/or the reception member 320 may have a width in a range of about 1 mm to about 10 mm, and the label plate 310 may have a width in a range of about 8 mm to about 50 mm. In an example, the label plate 310, the first guide member 340, the second guide member 350, and the reception member 320 may have any suitable width. In an example, the label plate 310 may have a length in a range of about 20 mm to about 70 mm. In another example, the label plate 310 may have any suitable length.

The terminology used herein is intended to describe particular embodiments only and is not intended to be limiting of the invention. As used herein, the singular forms "a", "an" and "the" are intended to include the plural forms as well, unless otherwise indicated. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The foregoing description of examples of the present disclosure has been provided for the purposes of illustration and description. It is not intended to be exhaustive or to limit the invention to the precise forms disclosed. Obviously, many modifications and variations will be apparent to the practitioner skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A closet apparel organizer comprising:

a label plate having a first surface and a second surface;

a first body member connected to a first location of the label plate;

a second body member connected to a second location of the label plate;

a reception member connected to the first body member and the second body member, wherein the reception member is configured to engage with a closet rod and includes an entrance opening; and a label configured to be attached to the first surface of the label plate, wherein the label includes at least one of an apparel identification and a surface feature, wherein the first surface is facing in an outward direction away from the first and second body members and the second surface is facing in an inward direction towards the first and second body members.

2. The closet apparel organizer of claim 1, further comprising:

a first guide member connected between the first body member and the reception member; and a second guide member connected between the second body member and the reception member, wherein the first guide member and the second guide member are configured to guide the closet rod to the reception member.

3. The closet apparel organizer of claim 2, wherein a first end of the first body member and a first end of the second body member are connected to the label plate, a second end of the first body member and a second end of the second body member are opposite the first end of the first body member and the first end of the second body member, respectively, and the second end of the first body member and the second end of the second body member define a second entrance opening, wherein the second entrance opening is larger than the entrance opening.

4. The closet apparel organizer of claim 1, wherein the label plate includes a first end and a second end opposite the first end, wherein the first location is near the first end of the label plate and the second location is near the second end of the label plate.

5. The closet apparel organizer of claim 1, wherein the first body member is disposed at an obtuse angle with respect to the label plate and the second body member is disposed at an acute angle with respect to the label plate.

6. The closet apparel organizer of claim 5, wherein at least a portion of the first body member is bent down toward the entrance opening.

7. The closet apparel organizer of claim 1, wherein the reception member includes a first wire rack receiver and a second wire rack receiver, wherein the first wire rack receiver and the second wire rack receiver are configured to engage with a wire rack.

8. The closet apparel organizer of claim 1, wherein the reception member defines a longitudinal axis substantially perpendicular to the second surface of the label plate, and the reception member is configured to engage with the closet rod along the longitudinal axis so that the label plate can be seen from a side of the closet rod.

9. The closet apparel organizer of claim 1, wherein the surface feature includes at least one of Braille characters, shapes, patterns, and symbols configured to identify an apparel item.

10. A closet apparel organizer with an adjuster comprising:

a body comprising:

a label plate having a first surface and a second surface;

a first body member connected to a first location of the label plate;

a second body member connected to a second location of the label plate;

a reception member connected to the first body member and the second body member, wherein the reception member is configured to engage with a closet rod and includes an entrance opening, wherein the first surface is facing in an outward direction away from the first and second body members and the second surface is facing in an inward direction towards the first and second body members; and an adjuster comprising:

a second reception member having a first end and a second end opposite the first end, wherein the second reception member includes a third entrance opening;

a third guide member connected to the first end of the second reception member;

a fourth guide member connected to the second end of the second reception member, wherein the third guide member and the fourth guide member are configured to guide the closet rod to the second reception member; and a locking mechanism mounted to at least one of the second reception member, the third guide member, and the fourth guide member, wherein the locking mechanism is configured to releasably lock the body and the adjuster together, wherein the second reception member is placed inside the reception member.

11. The closet apparel organizer of claim 10, wherein the body further comprises a locking channel formed between the first body member and the reception member.

12. The closet apparel organizer of claim 11, wherein the locking mechanism comprises a locking tab mounted to the third guide member, wherein the locking channel and the locking tab are releasably locked.

13. The closet apparel organizer of claim 10, wherein the locking mechanism is mounted to the second reception member, wherein the locking mechanism comprises at least one bar configured to be inserted into a hole in the reception member.

14. The closet apparel organizer of claim 10, wherein the second reception member defines a second longitudinal axis substantially perpendicular to the second surface of the label plate, and the second reception member is configured to engage with the closet rod along the second longitudinal axis so that the label plate can be seen from a side of the closet rod.

15. The closet apparel organizer of claim 10, wherein the label plate includes a first end and a second end opposite the first end, wherein the first location is near the first end of the label plate and the second location is near the second end of the label plate.

16. The closet apparel organizer of claim 10, further comprising a label configured to be attached to the first surface of the label plate, wherein the label includes an apparel identification.

* * * * *